US006220594B1

(12) United States Patent
Peng

(10) Patent No.: US 6,220,594 B1
(45) Date of Patent: Apr. 24, 2001

(54) DEVICE FOR AUTOMATICALLY DISCRIMINATING DIE SPOT NUMBER

(76) Inventor: Yun-Ching Peng, 12F, 491 Ming Cheng 2nd Road, Kaohsiung 813 (TW)

( * ) Notice: Subject to any disclaimer, the term of this patent is extended or adjusted under 35 U.S.C. 154(b) by 0 days.

(21) Appl. No.: 09/305,443

(22) Filed: May 6, 1999

(51) Int. Cl.[7] ..... A63F 9/04
(52) U.S. Cl. ..... 273/146; 273/138.2
(58) Field of Search ..... 273/138.1, 138.2, 273/146; 463/16, 22, 40; 73/1 E, 514.01

(56) References Cited

U.S. PATENT DOCUMENTS 4,909,513 * 3/1990 Kiyono .
5,694,045 * 12/1997 Ikeda et al. .
6,095,991 * 8/2000 Krausman .

* cited by examiner

*Primary Examiner*—William M. Pierce

(74) *Attorney, Agent, or Firm*—Rosenberg, Klein & Lee

(57) ABSTRACT

A device is provided for automatically discriminating a spot number of an upward face of a die with six faces. The device includes a signal transmitter embedded in the dice and a receiver device. The receiver device includes a set of receiver and an operation computer. The signal transmitter includes a substrate embedded in the die with respect to one of the six faces of the die. A sensor chip is mounted on the substrate. The substrate further includes four comer areas each having a conductive element mounted thereon. Each mercury switch extends upward and outward from and electrically connects to each conductive element in a manner that each mercury switch is at an angle of 15°~75° with the substrate. Each mercury switch contains conductive mercury therein. The mercury in each mercury switch flows under gravity so as to be in one of a conductive status and a non-conductive status with respect to an associated conductive element, thereby generating a signal representing the status of the mercury switch. The operation computer discriminates the spot number of the upward face of the die according to the signals representing the status of the mercury switches.

2 Claims, 6 Drawing Sheets

DEVICE FOR AUTOMATICALLY DISCRIMINATING DIE SPOT NUMBER

BACKGROUND OF THE INVENTION

1. Field of the Invention

The present invention relates to a device that may automatically discriminate the spot S number ofthe upward face of the die.

2. Description of the Related Art

Dice have existed for a long time and are usually used in games, e.g., backgammon, "Monopoly", and other adventuring games to decide the play sequence and/or how many steps to move, thereby increasing the amusement effect Although computers may provide a random function to replace the possibility function of the dice, the amusement effect of throwing the dice is irreplaceable. Game machines nowadays create an environment to make the player feel like experiencing the real site, including game machines that require dice throwing The machine must be capable of detecting the spot number of the upward face of each die for next step. Thus, the die must send a signal to the machine for discriminating the spot number.

Taiwan Invention Patent Publication No. 247351 issued on May 11, 1995 discloses an apparatus for detecting a portion of a die and the die that can be detected at a portion thereof. Resonance circuits with different resonance frequencies are embedded under and adjacent to six faces of the die, respectively. When the die is rolling on a table, signals indicating identity of the resonance frequencies are transmitted in sequence to a signal transmitting circuit to cooperate with a detecting device for obtaining information of the spot numbers. Analogous signals are used in this apparatus and thus tend to be interfered by alien electrical waves. Embedding of the complicated circuits under the faces of the die is costly. The present invention is intended to provide a device that mitigates and/or obviates the above problems.

SUMMARY OF THE INVENTION

It is a primary object of the present invention to provide a device that automatically discriminates the spot number of the upward face of the die.

In accordance with the present invention a device is provided for automatically discriminating a spot number of an upward face of a die with six faces. The device comprises a signal transmitter embedded in the die and a receiver means. The receiver means includes a receiver and an operation computer. The signal transmitter includes a substrate embedded in the die with respect to one of the six faces of the die. A sensor chip is mounted on the substrate. The substrate further includes four corner areas each having a conductive element mounted thereon. A mercury switch extends upward and outward from and electrically connects to each conductive element in a manner that each mercury switch is at an angle of 15°~75° (preferably 45°) with the substrate. Each mercury switch contains conductive mercury therein.

The mercury in each mercury switch flows under gravity so as to be in one of a conductive status and a nonconductive status with respect to an associated conductive element, thereby generating a signal representing the status of the mercury switch The operation computer discriminates the spot number of the upward of of the die according to the signals representing the status of the mercury switches.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
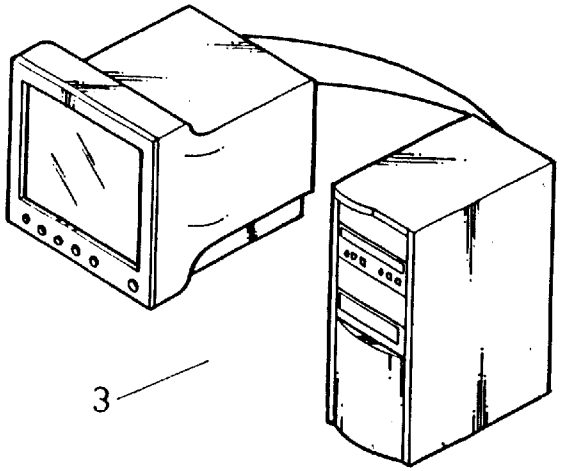
FIG. 1 is a perspective view of a device for automatically discriminating die spot number in accordance with the present invention, wherein the spot number of the upward face of the die is one.
Figure 1:
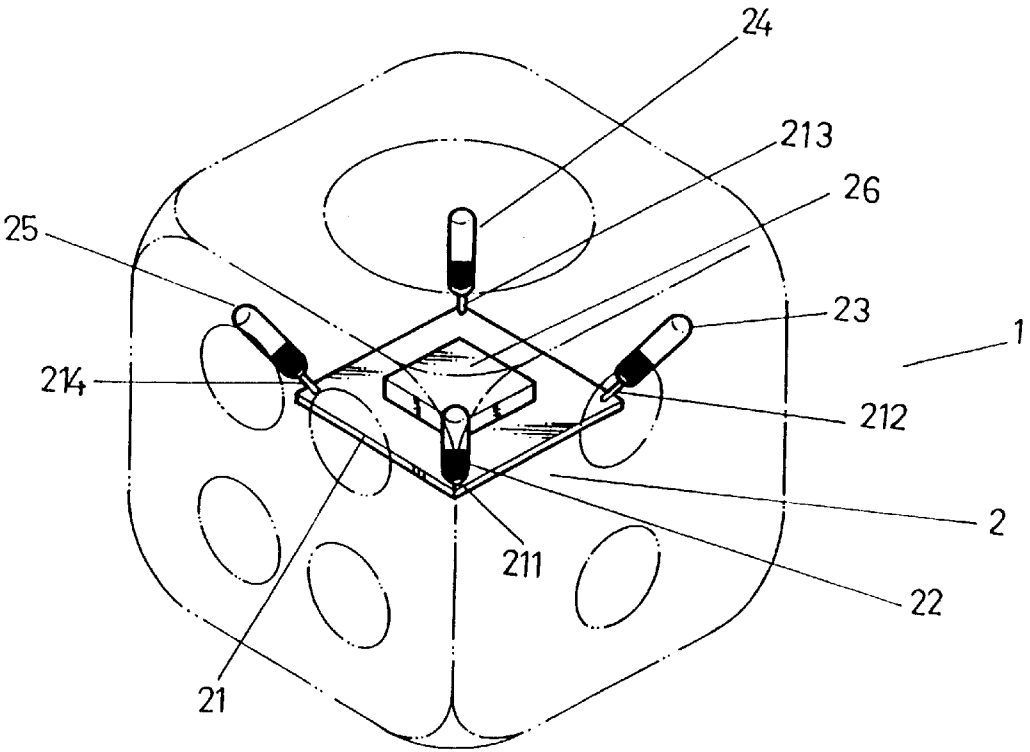

Referring to the drawings and initially to FIG. 1, a device in accordance with the present invention includes a die 1 with six faces and a receiving means 3. The receiver means 3 includes at least a signal receiver and an operation computer. A signal transmitter 2 is embedded in the die 1 and includes a substrate 21 and a sensor chip 26. The substrate 21 is embedded with respect to any one of the spot numbers of the die. For example, the substrate 21 extends in a direction parallel to one of the six faces of the die 1. The sensor chip 26 provides a radio frequency identification (RFID) function, yet detail of which is beyond the scope of the invention and therefore not further described. Each corner area of the substrate includes a conductive element 211, 212, 213, 214. A mercury switch 22, 23, 24, 25 extends upwardly and outwardly from and electrically connected to each conductive element 211, 212, 213, 214. Each mercury switch 22, 23, 24, 25 is at an angle of 15°~75° (preferably 45°) with the substrate 21. Each mercury switch contains conductive mercury therein. In order to explain the principle of the invention, as the mercury flows under the gravity, it is defined that the signal representing a conductive status of each mercury switch with respect to the associated conductive element (the mercury switch is "ON") is "1" and the signal representing a nonconductive status of each mercury switch with respect to conductive element (the mercury switch is "OFF") is "0". The signals of the mercury switches 22, 23, 24, and 25 are collected in sequence to discriminate the spot number of upward face of the die 1.

Figure 2:
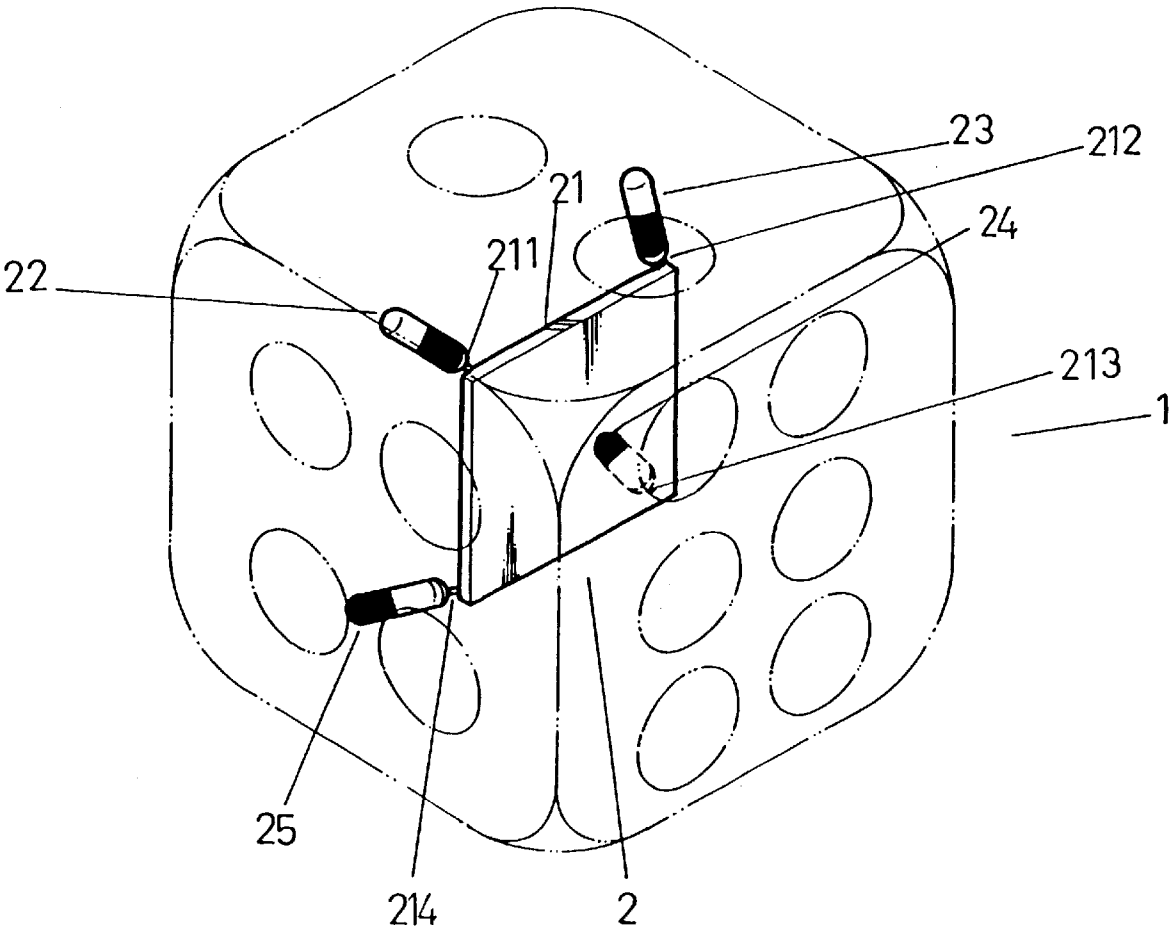
FIG. 2 is a perspective view of the die, wherein the spot number of the upward face of the die is two.

Still referring to FIG. 1, when the face with one (1) spot of the die 1 faces upward, every mercury switch 22, 23, 24, and 25 is "ON". A signal of "1111" is obtained by the receiving means 3, and it can be discriminated that it is the face with two spots that faces upward Referring to FIG. 2, when the face with two (2) spots faces upward, mercury switches 22 and 23 are "ON" while mercury switches 24 and 25 are "OFF". A signal of "1100" is obtained by the receiving means 3, and it can be discriminated that it is the face with two spots that faces upward.

Figure 3:
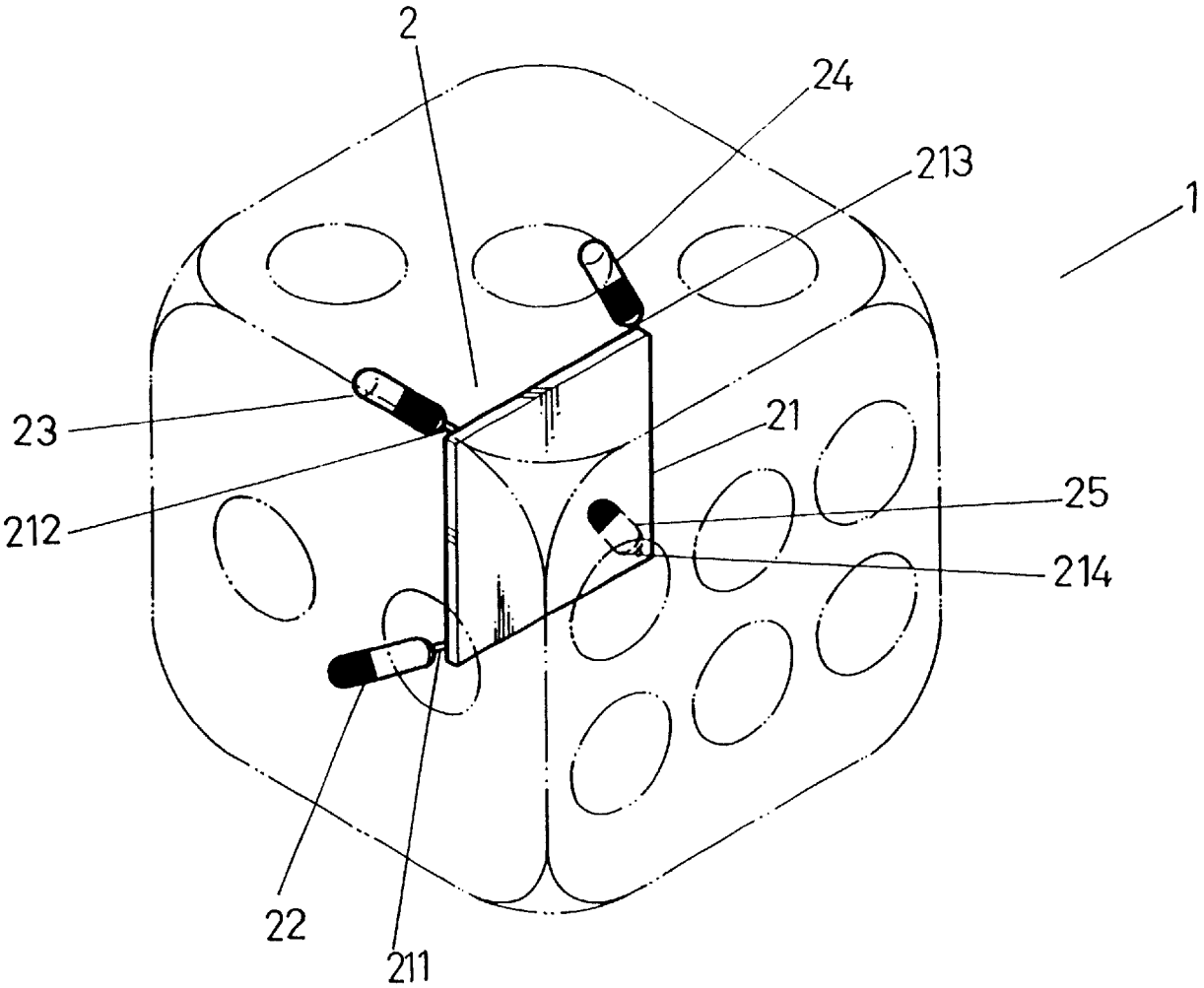
FIG. 3 is a perspective view of the die, wherein the spot number of the upward face of the die is three.

Referring to FIG. 3, when the face with three (3) spots faces upward, mercury switches 22 and 25 are "OFF" while mercury switches 23 and 24 are "ON". A signal of "0110" is obtained by the receiving means 3, and it can be discriminated that it is the face with three spots that faces upward.

Figure 4:
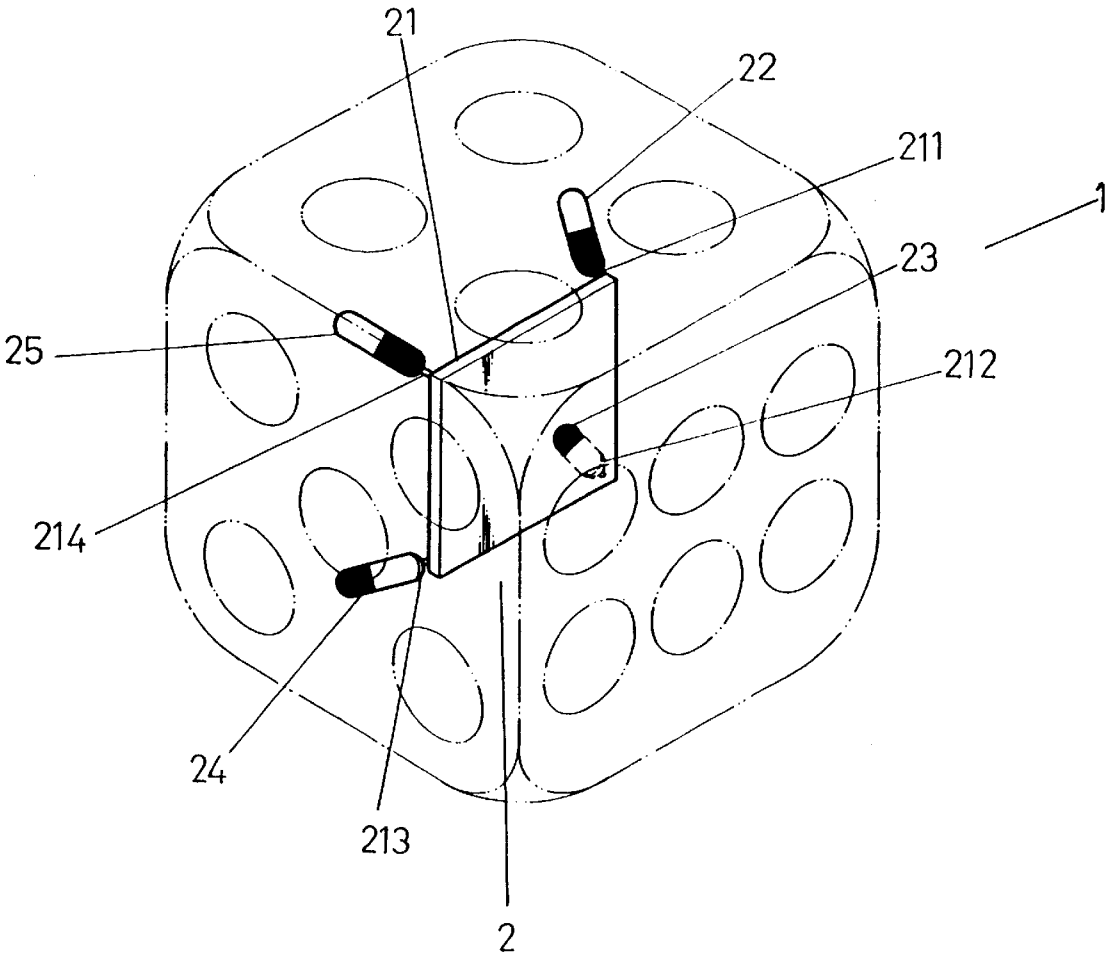
FIG. 4 is a perspective view of the die, wherein the spot number of the upward face of the die is four.
Figure 5:
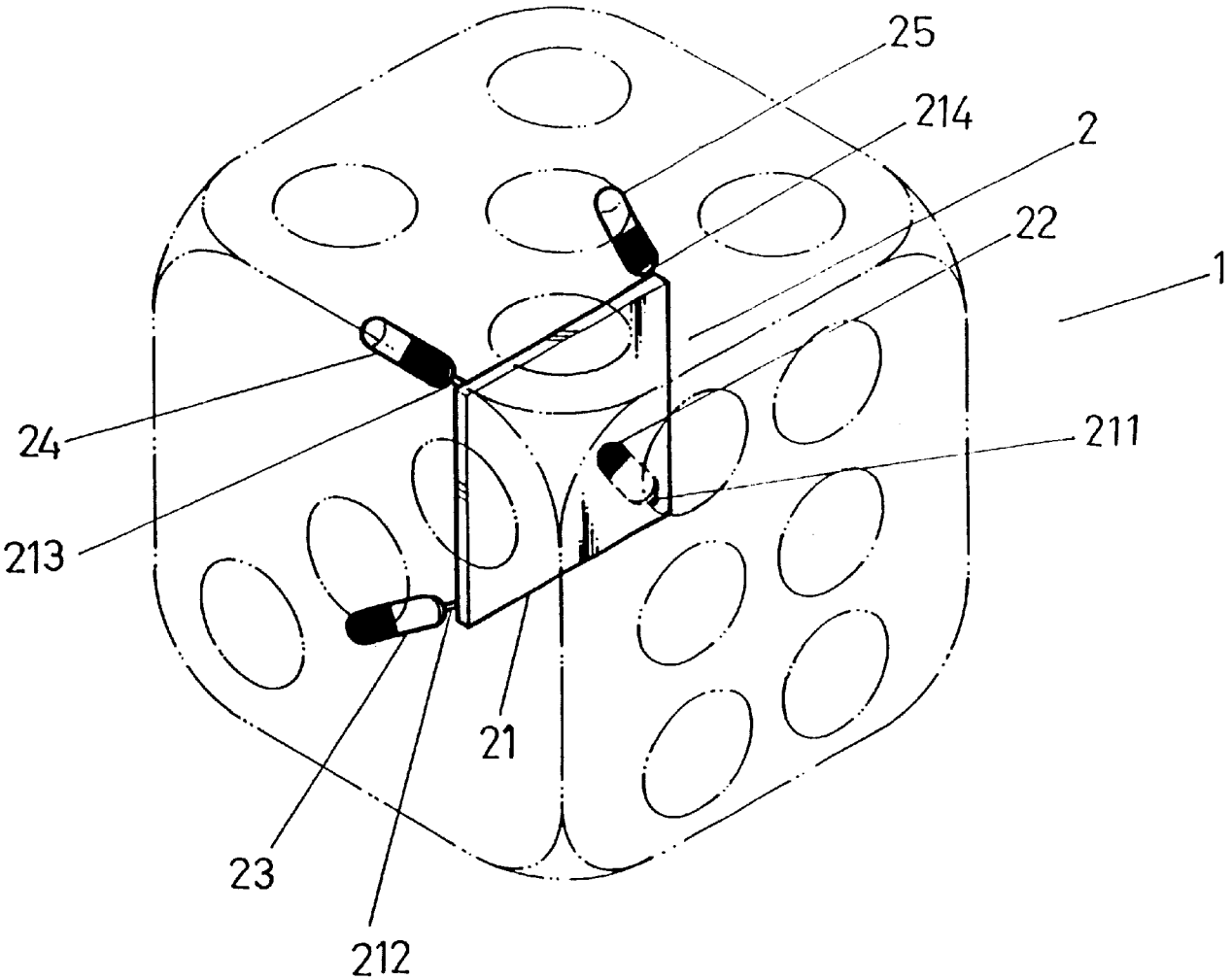
FIG. 5 is a perspective view of the die, wherein the spot number of the upward face of the die is five.

Referring to FIG. 4, when the face with four (4) spots faces upward, mercury switches 22 and 25 are "ON" while mercury switches 23 and 24 are "OFF". A signal of "1001" is obtained by the receiving means 3, and it can be discriminated that it is the face with four spots that faces upward Referring to FIG. 5, when the face with five (5) spots faces upward, mercury switches 22 and 23 are "OFF" while mercury switches 24 and 25 are "ON". A signal of "0011" is obtained by the receiving means 3, and it can be discriminated that it is the face with five spots that faces upward.

Figure 6:
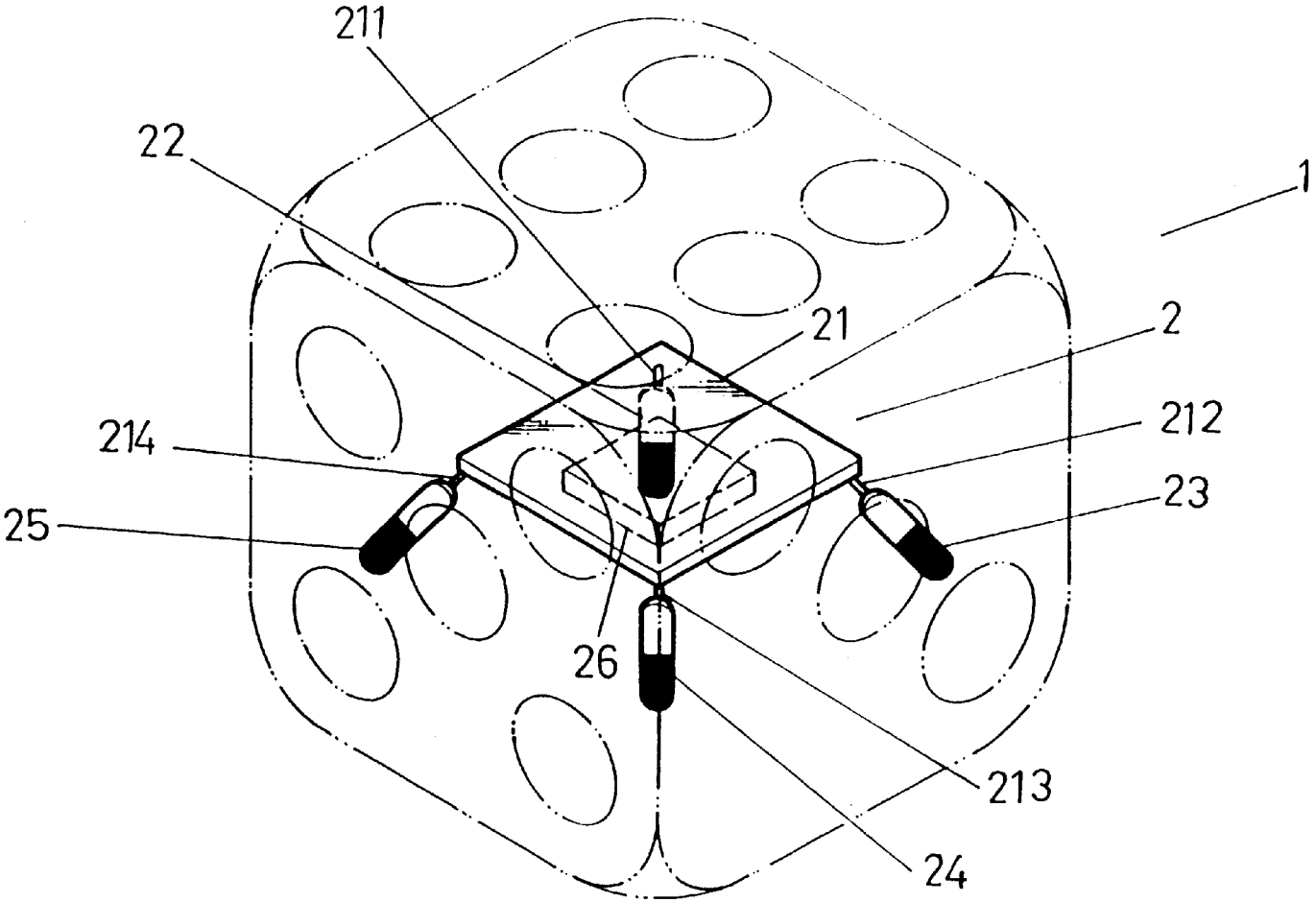
FIG. 6 is a perspective view of the die, wherein the spot number of the upward face of the die is six.

Referring to FIG. 6, when the face with six (6) spots faces upward, all of the mercury switches 22, 23, 24, and 25 are "OFF". A signal of "0000" is obtained by the receiving means 3, and it can be discriminated that it is the face with six spots that faces upward.

According to the above description, it is appreciated that the spot number of the upward face of the die can be precisely discriminated due to provisions of the mercury switches that extend upward and outward by an angle of 15°~75° and that contain flowable mercury. A game machine with the device of the present invention may immediately judge the total points of the dice thrown.

Although the invention has been explained in relation to its preferred embodiment, it is to be understood that many other possible modifications and variations can be made without departing from the spirit and scope of the invention as hereinafter claimed.

What is claimed is:

1. A device for automatically discriminating a spot number of an upward face of a die having six faces, the device comprising:

a signal transmitter embedded in the die having six faces, the signal transmitter including a substrate embedded in the die with respect to one of the six faces of the die, a sensor chip being mounted on the substrate, the substrate further including four corner areas each having a conductive element mounted thereon, a mercury switch being extended upward and outward from and electrically connected to each said conductive element in a manner that each said mercury switch is at an angle of 15°~75° with the substrate, each said mercury switch containing conductive mercury therein; and, receiver means for receiving signals from said signal transmitter, said receiver means including a receiver and an operation computer, whereby the mercury in each said mercury switch flows under gravity so as to be in one of a conductive status and a non-conductive status with respect to an associated said conductive element, thereby generating a signal representing the status of the mercury switch, and whereby the operation computer discriminates the spot number of the upward face of the die according to the signals representing the status of the mercury switches.

2. The device as claimed in claim 1, wherein each said mercury switch is at an angle of 45° C. with the substrate.

* * * * *